US009833798B2

(12) United States Patent
Rymer

(10) Patent No.: US 9,833,798 B2
(45) Date of Patent: Dec. 5, 2017

(54) DISPENSER

(71) Applicant: Matthew Tait Phillips, Somersby (AU)

(72) Inventor: Keith Rymer, Spencer (AU)

(73) Assignee: Matthew Tait Phillips, Somersby, New South Wales (AU)

( * ) Notice: Subject to any disclaimer, the term of this patent is extended or adjusted under 35 U.S.C. 154(b) by 0 days.

(21) Appl. No.: 14/640,501

(22) Filed: Mar. 6, 2015

(65) Prior Publication Data

US 2015/0251842 A1 Sep. 10, 2015

(30) Foreign Application Priority Data

Mar. 10, 2014 (AU) ..... 2014900800

(51) Int. Cl.
*B05B 11/00* (2006.01)
*A61D 7/00* (2006.01)

(52) U.S. Cl.
CPC ..... *B05B 11/0018* (2013.01); *A61D 7/00* (2013.01); *B05B 11/0064* (2013.01); *B05B 11/3047* (2013.01); *B05B 11/3069* (2013.01); *B05B 11/3074* (2013.01)

(58) Field of Classification Search
CPC ..... B05B 11/0072; B05B 11/0064; B05B 11/3047; B05B 11/3069; B05B 11/3074; B05B 11/0059; B05B 11/0021; B05B 11/0018; B05B 11/3087; B05B 11/3001; A61F 9/0008
USPC ..... 222/361.6, 361.7, 380, 420–422, 335, 222/492–495, 321.6–321.9, 320–321.9, 222/378, 383, 385, 383.1, 481.5, 482
See application file for complete search history.

(56) References Cited

U.S. PATENT DOCUMENTS 3,827,601 A * 8/1974 Magrath ..... A61M 5/162 222/324
4,260,082 A * 4/1981 Rooney ..... G01F 11/04 222/340
4,775,079 A * 10/1988 Grothoff ..... B05B 11/0059 222/321.4
4,830,284 A * 5/1989 Maerte ..... B05B 11/0067 222/321.6
5,370,318 A * 12/1994 Weston ..... B05B 11/0064 222/494
5,542,580 A * 8/1996 Hatakeyama ..... B05B 11/0043 222/183
5,655,686 A * 8/1997 Jermyn ..... A61M 3/0262 222/211
6,062,433 A * 5/2000 Fuchs ..... B05B 11/0016 222/153.13
6,253,961 B1 * 7/2001 Anderson ..... B05B 11/0018 222/309
6,308,867 B1 * 10/2001 Wolter ..... B05B 11/3053 222/321.6

(Continued)

*Primary Examiner* — Paul R Durand
*Assistant Examiner* — Charles P Cheyney
(74) *Attorney, Agent, or Firm* — Kilpatrick Townsend & Stockton LLP

(57) ABSTRACT

A dispenser (10) to deliver a liquid medication. The dispenser (10) includes a hollow reservoir body (11) providing an interior that receives the liquid. The body (11) has a threaded neck (13) that receives a cap (58). The cap (58) includes a pump assembly (17) and a nozzle member (29). The pump assembly (17) includes a vent one-way (48) that provides for the delivery of air to the interior of the reservoir (11).

8 Claims, 3 Drawing Sheets

(56) References Cited

U.S. PATENT DOCUMENTS

| | | | | |
|---|---|---|---|---|
| 6,851,583 | B2 * | 2/2005 | Masuzzo | B05B 11/0005 222/321.6 |
| 7,004,356 | B1 * | 2/2006 | Sayers | B05B 7/0037 222/137 |
| 7,389,893 | B2 * | 6/2008 | Kasting | B05B 11/0059 222/321.4 |
| 7,461,762 | B2 * | 12/2008 | Law | B05B 7/0025 222/137 |
| 8,267,284 | B2 * | 9/2012 | Ray | A47K 5/1207 222/145.5 |
| 9,648,992 | B2 * | 5/2017 | Harris | B05B 11/0018 |
| 2005/0051579 | A1 * | 3/2005 | Kasting | B05B 11/306 222/321.7 |
| 2005/0173460 | A1 * | 8/2005 | Masuda | B05B 11/0018 222/321.7 |
| 2014/0034679 | A1 * | 2/2014 | Fitzpatrick | A47K 5/16 222/190 |
| 2015/0076176 | A1 * | 3/2015 | Ray | A47K 5/1211 222/189.11 |

* cited by examiner 2
14
10
11
19
51
51
17
29
31
15
2

15
14

10
11
12
42
48
24
19
13
57
50
17
52
31
30
29
32

15
12
11
10
48
47
45
42
46
56
44
26
41
43
25
36
24
19
23
13
50
55
22
20
40
37
27
39
28
18
49
57
21
38
34
33
35
17
59
31
29

DISPENSER

CROSS-REFERENCE TO RELATED APPLICATIONS

This application claims the priority of Australian Provisional Patent Application No. 2014900800, filed Mar. 10, 2014, the disclosure of which is incorporated herein by reference.

FIELD

The present invention relates to dispensers that delivers a liquid, and more particularly but not exclusively to a dispenser that will deliver a liquid medication to animals, such as companion animals.

BACKGROUND

There are a variety of means via which a liquid, such as a medication, can be delivered to an animal, such as a companion animal. For example, the medication may be delivered via a collar, orally via tablet, or in some instances a "spot-on" applicator. A particular example of an applicator is a satchel that is compressed to expel the contents from the satchel.

In use of pump delivery devices, the reservoirs are open to atmosphere in order for the pumps to be able to draw liquid from the reservoir. This can lead to contamination of the liquid being dispensed.

Further disadvantages of the devices/methods that dispense a medication to an animal include inaccuracies in the dose volume, efficiency of the medication due to the method of delivery, as well as difficulty in respect of applying the medication.

OBJECT

It is the object of the present invention to overcome or substantially ameliorate at least one of the above disadvantages.

SUMMARY OF INVENTION

There is disclosed herein a dispenser to deliver a liquid, the dispenser including:

a reservoir having an interior to receive a volume of the liquid;

a pump communicating with the reservoir to draw the liquid from the reservoir; an inlet one-way valve between the reservoir and pump via which liquid passes from the reservoir to the assembly;

a delivery passage, to receive liquid from the pump, to deliver the liquid to a delivery outlet via movement of the liquid in a delivery direction;

an outlet one-way valve operatively associated with the pump and delivery passage;

a vent one-way valve providing for the flow of air from atmosphere to said interior; and wherein the inlet and outlet one-way valves operate to provide for the flow of liquid in said delivery direction from the reservoir to the delivery outlet while inhibiting movement of the liquid in a direction opposite said delivery direction.

Preferably, the reservoir includes a hollow body providing said interior, with said pump being fixed to said hollow body, and wherein said vent one-way valve is attached to the pump and communicates with said interior.

Preferably, said body has a base upon which the dispenser can rest, with said vent one-way valve being spaced from said base.

Preferably, said vent one-way valve is positioned so as to be above the liquid when the dispenser is resting on said base.

Preferably, said vent one-way valve is formed of resilient material and is urged closed, but resiliently deforms to open when pressure in said interior is below atmospheric pressure.

There is further disclosed herein a dispenser to deliver a liquid, the dispenser including:

a pump assembly providing a pump chamber having a pump inlet, and an outlet passage extending from the chamber to an outlet opening, a piston in the chamber cooperating with the chamber to generally enclose a pump volume, with relative movement between the chamber and piston changing said volume to deliver the liquid in a delivery direction to the outlet passage, with said dispenser further including;

an inlet one-way valve operatively associated with the pump inlet to provide for the delivery of the liquid thereto while inhibiting movement of liquid through the inlet valve in a direction opposite said delivery direction;

an outlet one-way valve operatively associated with the outlet passage to provide for the delivery of the liquid to the outlet opening, while inhibiting movement of the liquid along the outlet passage in said opposite direction; and wherein the inlet valve includes a movable valve element, the movable valve element being movable between an open position and a closed position, with the element in the closed position preventing movement of the liquid in said opposite direction, while in the open position providing for the delivery of liquid to the chamber, with said element being urged to the closed position when said passage is generally upwardly oriented and said direction is generally upwardly oriented.

Preferably, said element is urged to the closed position under the influence of gravity when the passage is generally upwardly oriented.

Preferably, the dispenser further includes a spring urging the element to the closed position.

Preferably, said pump including a pump cylinder within which the piston is located, with the pump cylinder providing the pump inlet.

Preferably, the dispenser further includes a reservoir having an interior to receive the liquid, and a vent one-way valve providing for the flow of air from atmosphere to said interior when pressure in said interior is less than atmosphere.

A dispenser, further including a pump assembly said pump assembly including:

a pump body providing a pump cylinder;

a piston slidably mounted in the cylinder and co-operating therewith to provide a pump chamber;

the vent one-way valve;

the outlet one-way valve;

the inlet one-way valve, and a nozzle attached to the piston, with the nozzle and reservoir gripped by a user to cause relative movement therebetween to cause the liquid to be delivered.

Preferably, the reservoir includes a hollow body with a neck, and said pump assembly is mounted on the neck to act as a cap closing said neck.

Preferably, the pump body has a threaded sleeve, and said neck is threaded and engaged with the sleeve.

Preferably, the pump body provides an annular cavity, between the sleeve and cylinder, that receives said neck.

Preferably, the cylinder has an inner transverse wall providing a location for the inlet one-way valve, with said vent one-way valve being mounted on the transverse wall.

Preferably, the inlet valve includes a movable valve element, the movable valve element being movable between an open position and a closed position, with the element in the closed position preventing movement of the liquid in said opposite direction, while in the open position providing for the delivery of liquid to the chamber, with said element being urged to the closed position when said passage is generally upwardly oriented and said direction is generally upwardly oriented.

Preferably, said element is urged to the closed position under the influence of gravity when the passage is generally upwardly oriented.

Preferably, the dispenser further includes a spring urging the element to the closed position.

Preferably, said pump including a pump cylinder within which the piston is located, with the pump cylinder providing the pump inlet.

Preferably, the dispenser further includes a reservoir having an interior to receive the liquid, and a one-way valve providing for the flow of air from atmosphere to said interior when pressure in said interior is less than atmosphere.

BRIEF DESCRIPTION OF DRAWINGS

Preferred forms of the present invention will now be described by way of example with reference with the accompanying drawings wherein.

DESCRIPTION OF EMBODIMENTS

Figure 1:
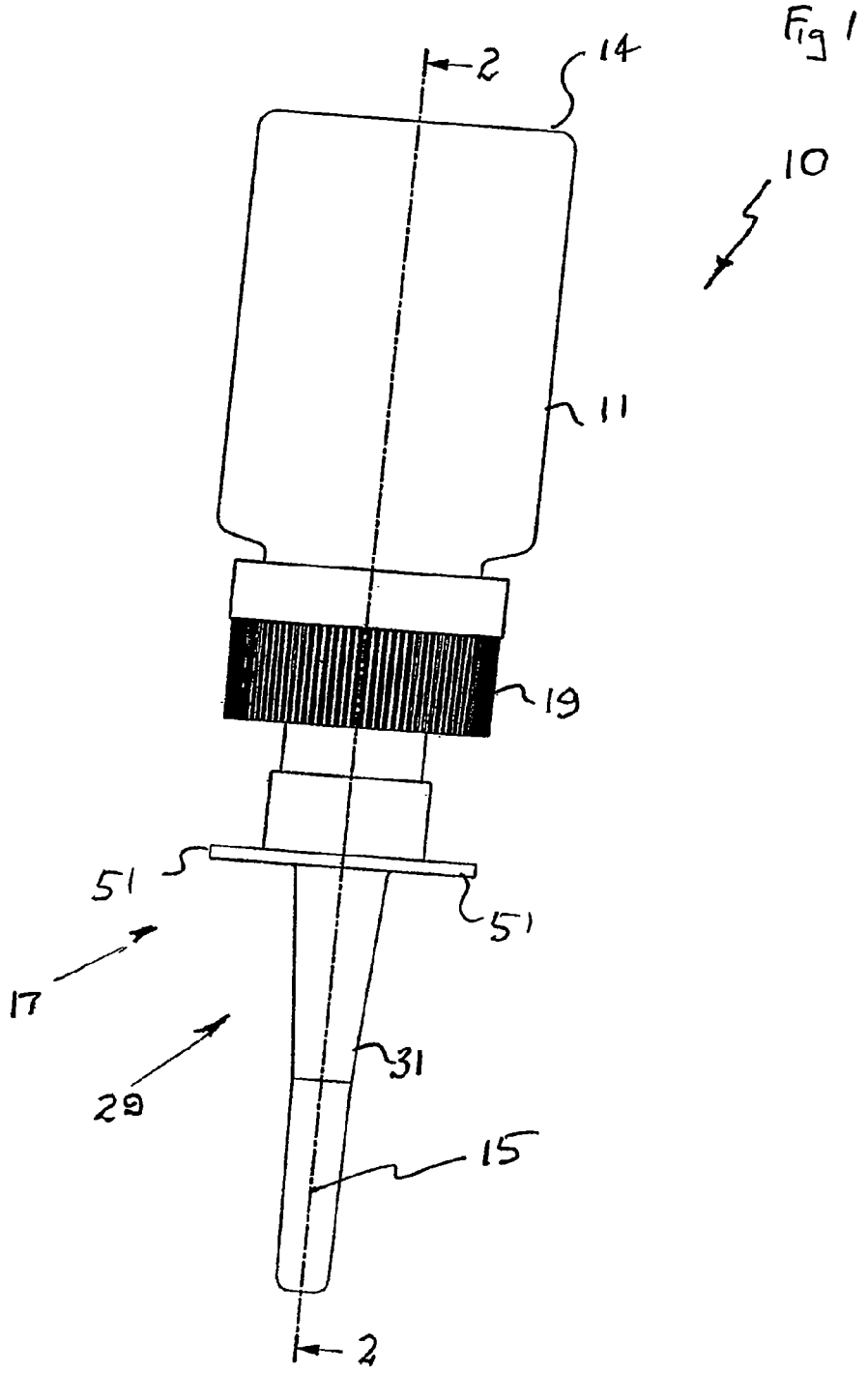
FIG. 1 is a schematic side elevation of a dispenser.
Figure 2:
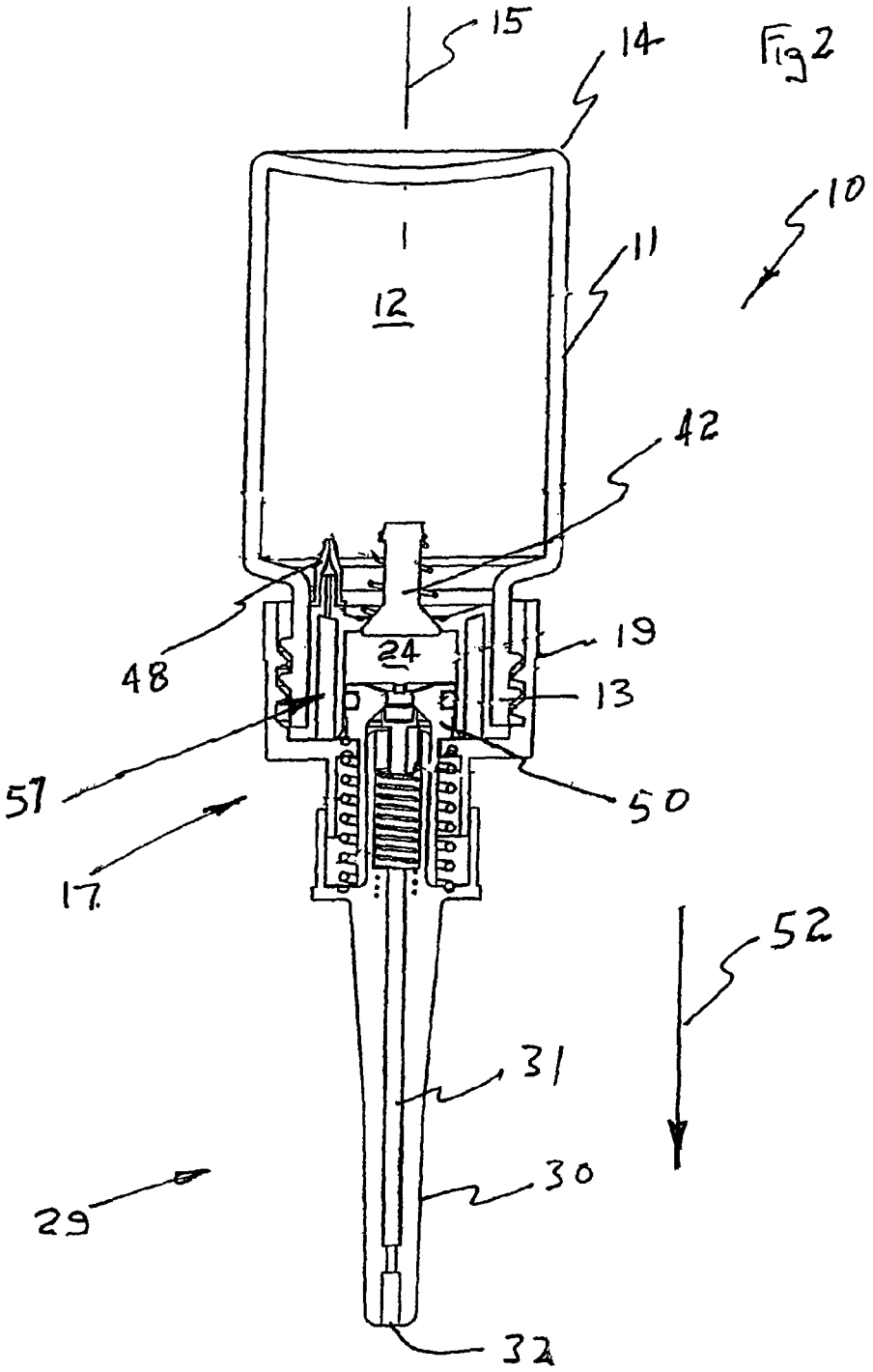
FIG. 2 is a schematic sectioned side elevation of the dispenser of FIG. 1 sectioned along the line 2-2.
Figure 3:
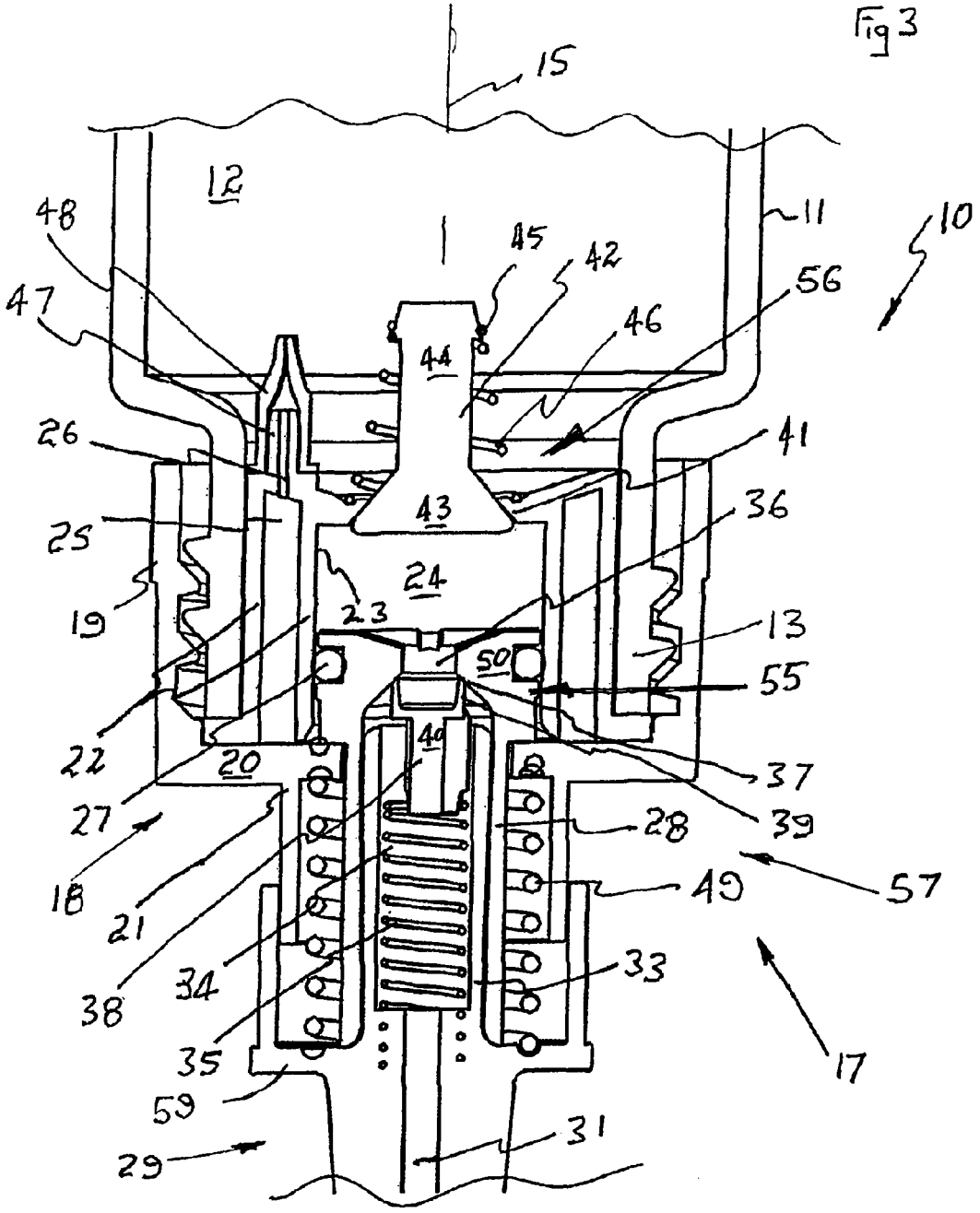
FIG. 3 is an enlarged view of portion of the dispenser as seen in FIG. 2.

In the accompanying drawings there is schematically depicted a dispenser 10. As one example, the dispenser 10 may be a metered pump device that can deliver multiple metered doses. As a further example, the dispenser 10 may be a "spot-on" delivery device that delivers a medication to companion animals.

The dispenser 10 includes a hollow body 11 providing a reservoir. The body 11 encloses an interior 12 that receives a liquid, such as a medication to be dispensed.

At one end of the body 11 there is provided a threaded neck 13, while at the opposite end the body 11 has a base 14 upon which the dispenser 10 can rest on a supporting surface. When resting on the base 14, the longitudinal central axis 15 is generally upwardly extending from the base 14.

Mounted on the neck 13 is a pump assembly 17. The pump assembly 17 is adapted to draw liquid from the interior 12 and dispense metered doses of the liquid. The pump assembly 17 includes a body 18 providing a cylindrical sleeve 19 that is internally threaded and threadably engaged with the neck 13. The body 18 also has a radially extending annular flange 20 that extends inwardly toward the axis 15 from the sleeve 19. Extending from the flange 20 is a further sleeve 21. Liquid moves through the pump assembly 17 in a delivery direction 52.

The pump assembly 17 further includes a pump 57 provided by a cylinder 22 and piston 50. The cylinder 22 abuts an internal surface of the flange 20 and is located internally relative to the sleeve 19. The cylinder 22 includes a cylindrical surface 23 that surrounds a pump chamber 24. The cylinder 22 includes an annular cavity 25 from which there extends a passage 26. The cavity 25 communicates with atmosphere.

Located in the chamber 24 and slidably engaged with the surface 23 is the piston 50 that includes an O-ring 27 that sealingly connects the piston 50 with the surface 23.

The piston 50 includes an axially extending sleeve 28 that is located internally relative to the sleeve 21.

Attached to the piston 50, by being fixed to the sleeve 28, is a nozzle member 29. The nozzle member 29 includes an elongated nozzle 30 having a longitudinal passage 31 that communicates with an end opening 32 via which the liquid is dispensed, preferably in a spray form.

The member 29 further includes a sleeve 33 that is fixed to the piston 50 by being secured to the sleeve 25.

Located internally of the sleeve 33 is a chamber 34 that communicates with the passage 31. Located in the chamber 33 is a spring 35.

The piston 50 has a longitudinal passage 36 having adjacent one and thereof a valve seat 37. Operatively associated with the seat 37 is a movable valve element 38 having and end portion 39 that engages the seat 37 to close the passage 36. The element 38 has a stem 40 engaged by the spring 35. The spring 35 is compressed and urges the movable valve element 38 into seated engagement with the seat 37 to close the passage 36. The seats 37, element 38 and spring 35 provide a one-way valve 55 preventing liquid being opposite the direction 52.

The passage 36 communicates with the chamber 24, and also communicates with the chamber 34 when the valve element 39 is disengaged with the seat 37.

The cylinder 22 has an inlet passage provided by a valve seat 41. Operatively associated with the valve seat 41 is a movable valve element 42 having an end portion 43 sealingly engageable with the seat 41. The element 42 also has a stem 44 extending from the end portion 43 and having an annular projection 45. Extending between the projection 45 and the cylinder 22 is a spring 46. The spring 46 is compressed so as to urge the element 42 to a closed position, that is with the end portion 43 engaged with the seat 41. The seat 41, element 42 and spring 46 provide a one-way valve 56 preventing liquid moving in a direction opposite the direction 52.

The cylinder 22 also has a cylindrical projection 47 providing the passage 26. Fitted over the projection 47 is a vent one-way valve 48. Preferably the valve 48 would be formed of resilient material so as to be urged to a closed configuration. However the valve 48 is resiliently deformably (to an open configuration) to provide for the flow of air from the cavity 25, through the passage 26 to the chamber 24.

The one-way valve 48 is located at a position adjacent the neck 13, that is one end of the interior 12. More particularly the one-way valve 48 is located adjacent the pump 51. Accordingly, when the dispenser 10 rests on its base 14, the one-way valve 48 is located above liquid level in the interior 12.

The pump assembly 17 is essentially a cap 58 attached to the neck 13. The pump body 18 not only provides the cylinder 22 but an inner transverse wall 53 (part of the cylinder 22) providing the seat 41. The valve 48 is also mounted in the wall 53. The body 18 also provides an annular cavity 54, between the cylinder 22 and sleeve 19, that receives the neck 13.

Accordingly the pump assembly includes the body 18, the one-way valves 48, 55 and 56, the piston 50, and the nozzle 30.

In operation of the above described dispenser 10, the interior 12 receives a volume of liquid to be dispensed. Preferably, the dispenser 10 is operated so that the nozzle 30 is downwardly extending in the direction 16. Thereafter a user positions the dispenser 10 so that the body 11 is located in the palm of a user's hand. The user then by use of one or more fingers engaged with the lateral projection 51 of the nozzle member 29, moves the nozzle member 29 in a direction opposite the direction 16 relative to the body 11. This in turn moves the piston 50 relative to the cylinder 22 to reduce volume of the interior 24. Any liquid contained in the interior 24 will then be under pressure and cause the valve element 38 to move to the open position. Once the element 38 is in the open position, liquid in the chamber 24 flows through the passage 36 to be delivered to the passage 31, as a result of reduction in the volume of the chamber 24. The liquid is then dispensed via the end opening 32.

Once a measured dose has been delivered, the user relaxes the pressure applied to the nozzle member 29 (projections 51), causing the nozzle member 29 to move in the direction 16 relative to the body 11. This occurs under the influence of the spring 49 extending between the flange 20 and a flange 59 of the nozzle member 29. In particular, the spring 49 is under compression when no pressure is applied to the nozzle member 29.

As the piston 50 moves in the direction 16 relative to the body 11, when pressure is relaxed on the member 29, via the projections 51, liquid is drawn into the chamber 24 via the seat 41. In particular due to a reduction of pressure in the chamber 24, the end portion 43 of the valve element 42 moves away from the seat 41. This allows liquid to be drawn in from the interior 12 to the chamber 24.

As liquid is drawn from the interior 12, air is allowed to enter the interior 12 via the passage 61 and one-way valve 48. This enables pressure within the volume 12 to be at least approximate atmospheric pressure.

An advantage of the above described preferred embodiment is the "equalizing" of pressure in the interior 12 with respect to atmosphere, as provided by the one-way valve 48. A further advantage of the above described preferred embodiment is that when the dispenser 10 is resting on its base 14, the movable valve element 42 is urged under the influence of gravity to the closed position when resting on the base 14, the direction 16 is upward. The element 38 is also urged under the influence of gravity to the closed position when the dispenser 10 is resting on the base 14.

A still further advantage of the above described preferred embodiment is that the one-way valve 48 is located above liquid level when the dispenser 10 is resting on its base 14, that is with the direction 16 being an upward direction.

The invention claimed is:

1. A hand held dispenser to deliver a liquid, the dispenser being configured to be gripped in a user's palm to be able to be operated by the user's fingers, the dispenser including:

a hollow body providing a reservoir having an interior to receive a volume of the liquid and a base upon which the dispenser can rest, on a supporting surface, the hollow body having a neck through which the liquid passes;

a cap mounted on the neck and providing a pump assembly, the pump assembly including;

a pump communicating with the reservoir to draw the liquid from the interior, the pump including a pump body having a cylinder providing a pump chamber with a volume to receive the liquid, a piston slidably located in the cylinder so that movement between the cylinder and piston varies said volume;

a liquid inlet one-way valve between the reservoir and pump chamber via which liquid passes from the reservoir to the chamber;

a delivery nozzle mounted on the pump body and having a delivery passage, to receive liquid from the pump chamber, to deliver the liquid to a delivery outlet via movement of the liquid in a delivery direction, with the passage extending upwardly from said pump chamber when the dispenser is resting of said base, the nozzle being fixed to the piston so that upon a user gripping the dispenser the user can engage the nozzle to move the piston to reduce the volume;

a liquid outlet one-way valve operatively associated with the pump chamber and delivery passage;

an air vent one-way valve spaced from said base and providing for the flow of air from atmosphere to said interior when the dispenser is at rest, with the air vent one-way valve being positioned so as to be above the liquid when the dispenser is resting on said base;

a spring extending between the nozzle and pump body, urging the nozzle to move the piston to increase said volume to draw liquid into said pump chamber, and wherein the liquid inlet and liquid outlet one-way valves operate to provide for the flow of liquid in said delivery direction from the reservoir to the delivery outlet while inhibiting movement of the liquid in a direction opposite said delivery direction, with the liquid inlet valve taking liquid from the interior when said passage is downwardly extending from said pump chamber so as to deliver said liquid, and said air vent one-way valve is formed of resilient material and is urged closed, but resiliently deforms to open when pressure in said interior is below atmospheric pressure.

2. The dispenser of claim 1, wherein the pump body has a sleeve, and said neck is engaged with the sleeve.

3. The dispenser of claim 2, wherein the pump body provides an annular cavity, between the sleeve and cylinder, that receives said neck.

4. The dispenser of claim 1, wherein the liquid inlet valve includes a movable valve element, the movable valve element being movable between an open position and a closed position, with the element in the closed position preventing movement of the liquid in said opposite direction, while in the open position providing for the delivery of liquid to the chamber, with said element being urged to the closed position when said passage is upwardly oriented and said direction is upwardly oriented.

5. The dispenser of claim 1, wherein said element is urged to the closed position under the influence of gravity when the passage is upwardly oriented.

6. The dispenser of claim 1, wherein the dispenser further includes a spring urging the element to the closed position.

7. The dispenser of claim 1, wherein said pump body includes a base spaced from the neck, so that the interior is located between the neck and base, with the air vent one-way valve and liquid one-way valve being located adjacent the neck so that the liquid inlet one-way valve provides a pump inlet adjacent the neck with the liquid leaving the reservoir by entering the pump inlet.

8. The dispenser of claim 1, wherein the spring extending between the nozzle and pump body surrounds the delivery passage.

* * * * *